US010068523B2

(12) United States Patent
Akimoto

(10) Patent No.: US 10,068,523 B2
(45) Date of Patent: Sep. 4, 2018

(54) DISPLAY DEVICE

(71) Applicant: Japan Display Inc., Tokyo (JP)

(72) Inventor: Hajime Akimoto, Tokyo (JP)

(73) Assignee: Japan Display Inc., Tokyo (JP)

( * ) Notice: Subject to any disclaimer, the term of this patent is extended or adjusted under 35 U.S.C. 154(b) by 91 days.

(21) Appl. No.: 14/593,509

(22) Filed: Jan. 9, 2015

(65) Prior Publication Data

US 2015/0206474 A1 Jul. 23, 2015

(30) Foreign Application Priority Data

Jan. 17, 2014 (JP) ..... 2014-006987

(51) Int. Cl.
*G09G 3/3233* (2016.01)

(52) U.S. Cl.
CPC ... *G09G 3/3233* (2013.01); *G09G 2300/0866* (2013.01)

(58) Field of Classification Search
CPC ..... G09G 3/3233; G09G 2300/0809; G09G 2330/028
See application file for complete search history.

(56) References Cited

U.S. PATENT DOCUMENTS 6,583,775 B1 6/2003 Sekiya et al.
7,170,232 B2 1/2007 Miwa et al.
7,199,768 B2 4/2007 Ono et al.
9,305,492 B2 * 4/2016 Takahama ..... G09G 3/3266
2005/0052366 A1 * 3/2005 Kim ..... G09G 3/3233 345/76
2006/0077194 A1 * 4/2006 Jeong ..... G09G 3/3233 345/204
2007/0210994 A1 * 9/2007 Chen ..... G09G 3/3233 345/76
2007/0268210 A1 11/2007 Uchino
(Continued)

FOREIGN PATENT DOCUMENTS

JP 2001-060076 A 3/2001
JP 2004-280059 A 10/2004
(Continued)

OTHER PUBLICATIONS

Japanese Office Action dated Jun. 6, 2017 for corresponding Japanese Patent Application No. 2014-006987, With English Translation.
(Continued)

*Primary Examiner* — Kent Chang
*Assistant Examiner* — Scott Au
(74) *Attorney, Agent, or Firm* — Typha IP LLC

(57) ABSTRACT

The present invention provides a display device having a driving transistor for current-driving a light-emitting element provided in each pixel, wherein the drain of the driving transistor is connected to a first power source, the source of the driving transistor is connected to the light-emitting element and one end of a capacitor, and the gate of the driving transistor is connected to a voltage source via a first switch and simultaneously therewith is connected to the other end of the capacitor via a second switch; the other end of the capacitor is further connected to a signal line via a third switch; and the display device has a control circuit for selectively controlling the first power source to a plurality of voltages.

8 Claims, 12 Drawing Sheets

(56) References Cited

U.S. PATENT DOCUMENTS

| | | | | |
|---|---|---|---|---|
| 2009/0002405 | A1* | 1/2009 | Ozaki | G09G 3/325 345/690 |
| 2009/0213046 | A1 | 8/2009 | Nam | |
| 2010/0123700 | A1* | 5/2010 | Kim | G09G 3/3233 345/211 |
| 2013/0021316 | A1 | 1/2013 | Inoue et al. | |
| 2014/0118231 | A1* | 5/2014 | Yang | G09G 3/3258 345/82 |
| 2016/0133187 | A1* | 5/2016 | Li | G09G 3/3233 345/690 |

FOREIGN PATENT DOCUMENTS

| | | | |
|---|---|---|---|
| JP | 2006-003744 | A | 1/2006 |
| JP | 2007-310311 | A | 11/2007 |
| JP | 2008-009080 | A | 1/2008 |
| JP | 2009-134110 | A | 6/2009 |
| JP | 2011-013293 | A | 1/2011 |
| JP | 2013-137498 | A | 7/2013 |

OTHER PUBLICATIONS

Japanese Notice of Allowance dated Feb. 6, 2018 for corresponding Japanese Patent Application No. 2014-006987, with machine translation.

* cited by examiner

DISPLAY DEVICE

CROSS-REFERENCE TO RELATED APPLICATIONS

This application is based upon and claims the benefit of priority from the prior Japanese Patent Application No. 2014-006987, filed on 17, Jan. 2014, the entire contents of which are incorporated herein by reference.

FIELD

The present invention relates to a display device, and in particular to a technique for configuration of a pixel circuit.

BACKGROUND

In recent years, in a light-emitting display device for a mobile application, a demand for high definition and reduction in power consumption is increasing. As a display device for a mobile application, a liquid crystal display device (LCD), a display device utilizing organic light-emitting diodes (OLED), such as an organic EL display device, an electronic paper, or the like is adopted.

Among them, development of the organic EL display device is gone ahead in order to achieve thinning, high luminance, and increase in speed of the a display panel. The organic EL display device is a display device provided with pixels, each being composed of an organic light-emitting diode, where a response speed is fast because a mechanical action is not required, high-luminance display is made possible because of self-emitting of each pixel itself, and thinning can be made possible because a backlight is not required, so that the organic EL display device is expected as a next-generation display device.

For a pixel circuit for driving a pixel constituting a display portion of the organic EL display device, various configuration have been considered. As one of these configurations, there is a configuration provided with a power line and a power line scanning circuit for controlling the power line in addition to a conventional configuration where signal lines and scanning lines are arranged in a grid pattern (for example, Patent Literature 1 (Japanese Patent Application Laid-Open No. 2007-310311).

The present invention provides a display device that facilitates reduction of a pixel circuit accompanied by high definition. The present invention also provides a display device where a pixel circuit and a peripheral circuit have been simplified. Further, the present invention provides a display device where a process cost has been reduced or a material cost have been reduced.

SUMMARY

According to an embodiment of the present invention, there is provided a display device having a driving transistor (driving TFT) for current-driving a light-emitting element provided in each pixel, wherein the drain of the driving transistor is connected to a first power source, the source thereof is connected to the light-emitting element and one end of a capacitor, and the gate thereof is connected to the first power source via a first switch and is connected to the other end of the capacitor via a second switch; the other end of the capacitor is further connected to a signal line via a third switch; and the display device has a control circuit for selectively controlling the first control power source to a plurality of voltages.

Further, as a preferred aspect, there is provided the display device, wherein the control circuit selectively controls the first power source to first, second, and third voltages corresponding to a time when the light-emitting element is reset, a time when a signal is written in the capacitor, and a time when the light-emitting element is lightened, respectively.

Further, as still another preferred aspect, there is provided the display device, wherein the gate of the first switch, the gate of the second switch, and the gate of the third switch are connected to a first scanning line.

Further, as another preferred aspect, there is provided the display device, wherein the gate of the driving TFT is connected to a second power source via the first switch.

Further, as another preferred aspect, there is provided the display device, wherein the gate of the first switch and the gate of the third switch are connected to a first scanning line, and the gate of the second switch is connected to a second scanning line.

Further, as another preferred aspect, there is provided the display device, wherein the source of the driving TFT and the one end of the capacitor are connected to a light-emitting element via a fourth switch, and the gates of the second switch and the fourth switch are connected to a third scanning line.

DESCRIPTION OF EMBODIMENTS

Figure 1:
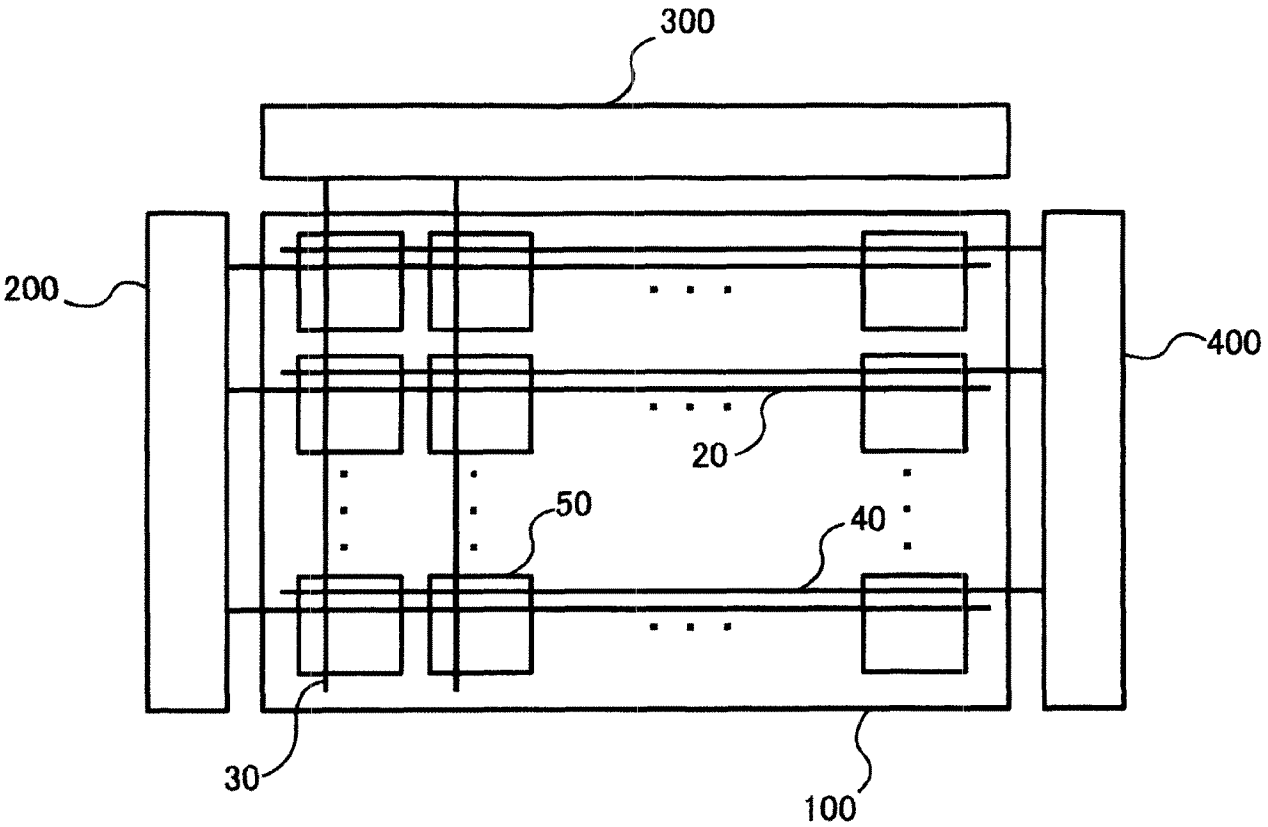
FIG. 1 is a schematic diagram showing a circuit configuration of a display device according to a first embodiment of the present invention.

Respective embodiments of the present invention is described below with reference to the drawings. It should be noted that only one example is disclosed here, and appropriate modifications falling into the scope of the present invention and easily anticipated by those skilled in the art are involved in the scope of the present invention, of course. Further, there is such a case that lengths, widths, thicknesses, shapes, and the like of respective portions are schematically represented as compared with actual aspects thereof in the figures in order to further clarify the explanation, which is only one example and does not limit interpretation of the present invention. In addition, in the specification and the drawings of this application, similar elements to elements previously described in relation to the aforementioned figures are attached with same reference numerals and detailed explanation thereof may be omitted properly.

<First Embodiment>

Figure 2:
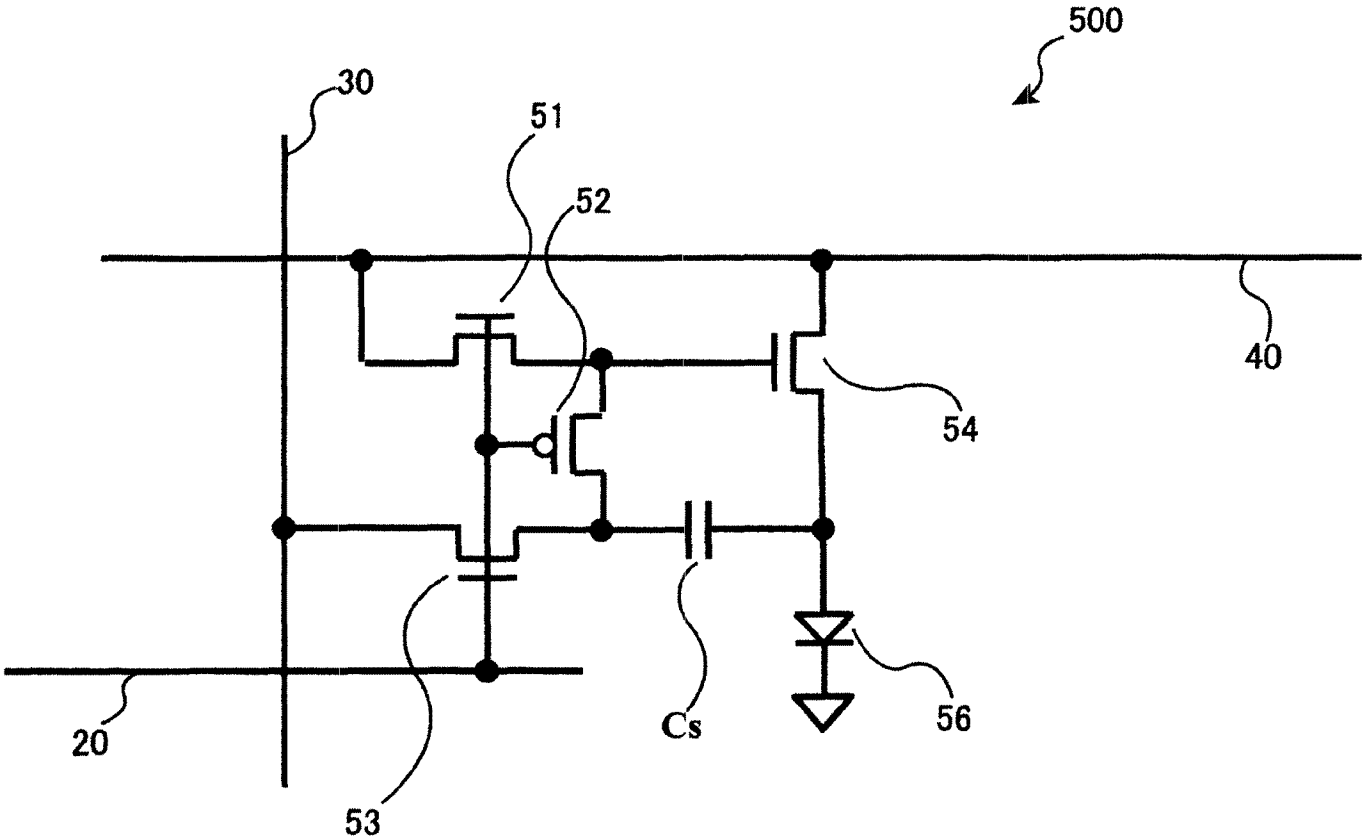
FIG. 2 is a schematic diagram of a pixel circuit of the display device according to the first embodiment of the present invention.

A configuration of a display device according to a first embodiment of the present invention will be described with reference to FIG. 1 to FIG. 6. FIG. 1 is a schematic diagram showing a circuit configuration of a display device according to the first embodiment of the present invention. FIG. 2 is a schematic diagram showing a pixel circuit of the display device according to the first embodiment of the present invention.

In a display device according to the first embodiment, as shown in FIG. 1, pixels 50 are arranged in a grid pattern to form a display region 100. Scanning lines 20 and power source lines 40 are arranged and connected to respective rows of the pixels 50 arranged in the grid pattern, respectively. Signal lines 30 are arranged and connected to respective columns of the pixels 50 arranged in the grid pattern, respectively. A vertical scanning circuit 200 for controlling electric signals of the scanning lines 20, a power source line scanning circuit 400 for controlling voltage values of the power source lines 40 and a data input circuit 300 for controlling electric signals of the signal lines 30 are arranged outside the display region 100, respectively. It should be noted that in FIG. 1, the vertical scanning circuit 200 is arranged on a left side of the display region 100, the data input circuit 300 is arranged on an upper side the display region 100, and the power source line scanning circuit 400 is arranged on a right side of the display region 100, but these arrangements, a positional relationship and the like are not limited to the configuration shown in FIG. 1.

Each pixels 50 constituting the display region 100 is provided with each of light-emitting elements, and a pixel circuit 500 shown in FIG. 2 is provided in order to cause to the light-emitting element to emit light. The pixel circuit 500 is composed of a potential supply TFT 51, a Cs connection TFT 52, a signal writing TFT 53, a driving TFT 54, a signal capacitor Cs, an organic EL element 56, the scanning line 20, the signal line 30, and the power source line 40.

The gate of the potential supply TFT 51, the gate of the Cs connection TFT 52, and the gate of the signal writing TFT 53 are connected to the scanning line 20. The drain of the potential supply TFT 51 is connected to the power source line 40, and the source of the potential supply TFT 51 is connected to the gate of the driving TFT 54 and the drain of the Cs connection TFT 52. The source of the driving TFT 54 is connected to one end of the signal capacitor Cs and an anode of the organic EL element 56. The source of the potential supply TFT 51 is connected to the power source line 40, and the gate of the potential supply TFT 51 together with the gate of the Cs connection TFT 52 and the gate of the signal writing TFT 53 is connected to the scanning line 20. The source of the signal writing TFT 53 is connected to the signal line 30, and the drain of the signal writing TFT 53 is connected to the other end of the signal capacitor Cs and the source of the Cs connection TFT 52. A cathode of the organic EL element 56 is connected to a ground electrode or a negative-potential electrode.

Here, the signal writing TFT 53 and the potential supply TFT 51 are n-MOS type transistors, and the Cs connection TFT 52 is a p-MOS type transistor. The first embodiment is characterized in that particularly the respective gates of the signal writing TFT 53, the potential supply TFT 51, and the Cs connection TFT 52 are collectively connected to the scanning line 20.

An action of the pixel circuit 500 will be described below with reference to FIG. 3 to FIG. 5.

Figure 3:
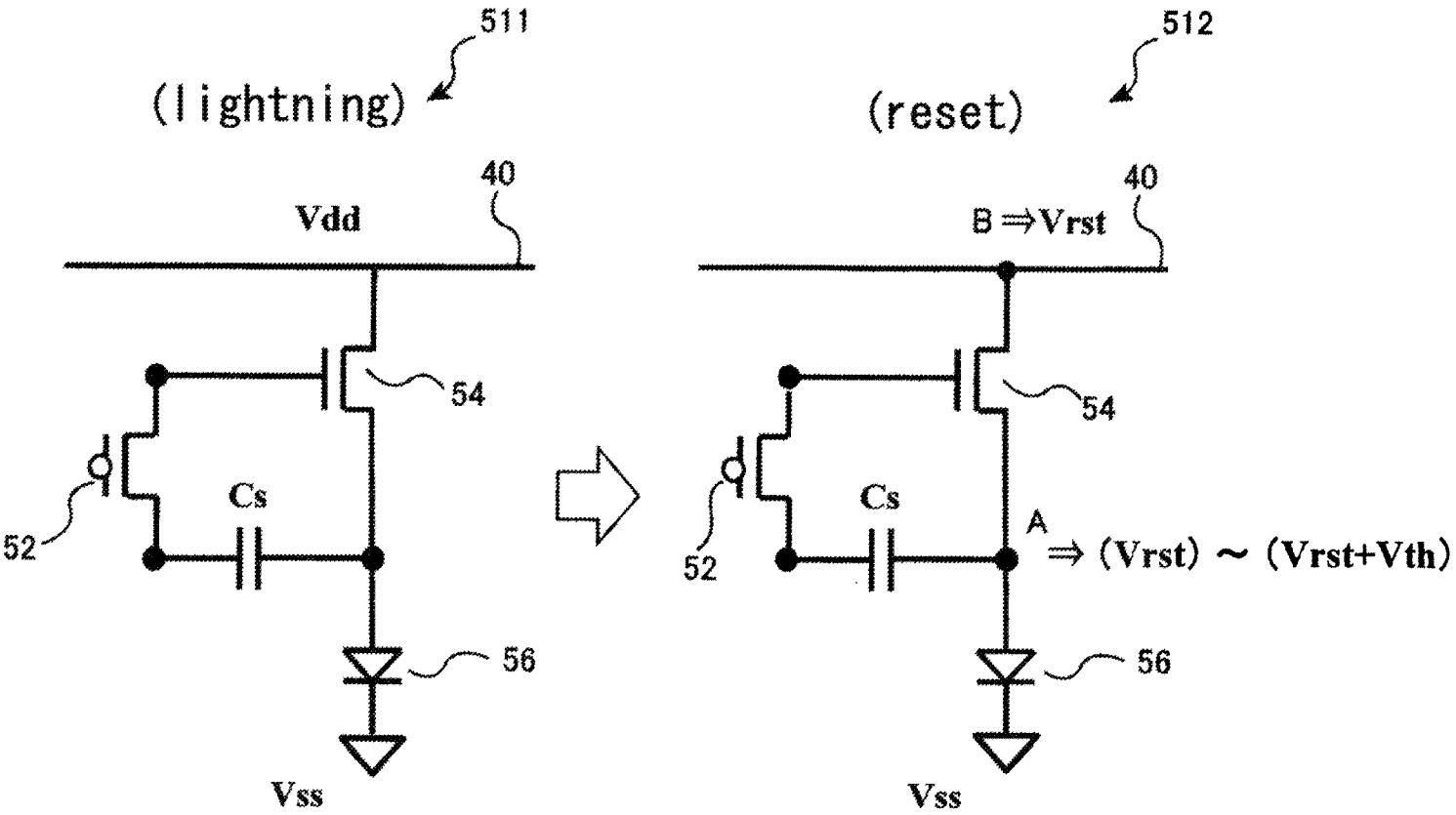
FIG. 3 is a schematic diagram showing an action of the pixel circuit of the display device according to the first embodiment of the present invention when a lightened pixel transits to a reset state.

FIG. 3 is a schematic diagram showing an action of the pixel circuit of the display device according to the first embodiment of the present invention when a lightened pixel transits to a reset state, where a left side indicates a lightened time while a right side indicates a reset time. At the lightened time, a scanning line voltage of the scanning line 20 takes a low voltage (represented as Vlow), and since the respective gates of the potential supply TFT 51 and the signal writing TFT 53 change low voltages to turn OFF, their illustrations are omitted in FIG. 3. Further, at the lightened time, the power source line scanning circuit 400 selectively scans the power source line 40 such that a voltage Vdd is applied to the power source line 40. The voltage Vdd takes 5 V, for example.

When transition from the lightened state to the reset state occurs, the power source line scanning circuit 400 selectively scans the power source line 40 such that the voltage of the power source line 40 changes from the voltage Vdd at the lightened time to a reset voltage Vrst. The reset voltage Vrst takes −3 V, for example.

At this time, when a voltage equal to or higher than the threshold voltage (represented as Vth) of the driving TFT 54 has been written in the signal capacitor Cs, the source of the driving TFT 54 is reset to the reset voltage Vrst. If the voltage written in the signal capacitor $C_S$ is 0 V, the voltage of the driving TFT 54 on the side of the source thereof is reset to the sum of the reset voltage Vrst and the threshold voltage Vth (represented as Vrst+Vth). Thus, the source of the driving TFT 54 is reset to a different voltage between the voltage Vrst and the voltage (Vrst+Vth) according to a signal voltage of the previous frame which has been previously written in the signal capacitor Cs, but the fact still remains that the source is reset to a value in the vicinity of the voltage Vrst. It should be note that a cathode voltage Vss of the organic EL element 56 takes −3 V, for example.

Figure 4:
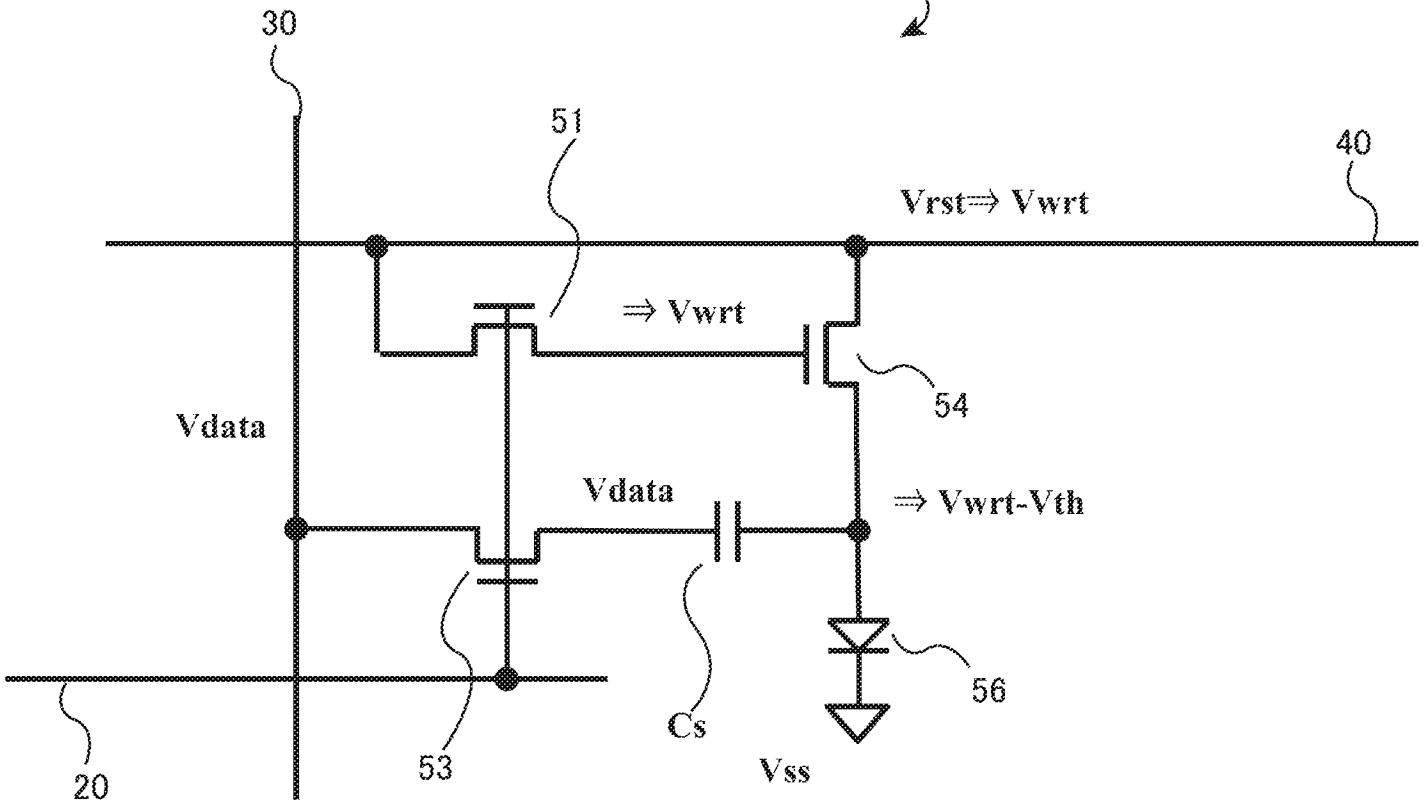
FIG. 4 is a schematic diagram showing a signal writing action of the pixel circuit of the display device according to the first embodiment of the present invention after reset.

FIG. 4 is a diagram showing a signal writing action of the pixel circuit of the display device according to the first embodiment of the present invention after rest.

At a signal writing time, the power source line scanning circuit 400 selectively scans the power source line 40 such that the voltage of the power source line 40 is changed from the reset voltage Vrst to a writing voltage Vwrt. The writing voltage Vwrt takes 1 V, for example. Simultaneously therewith, the vertical scanning circuit 200 selectively scans the scanning line 20 so as to change the voltage of the scanning line 20 from the low voltage Vlow to a high voltage Vhigh. Here, the low voltage Vlow is −4 V, for example, and the high voltage Vhigh is 8 V, for example. It should be noted that since the gate of the Cs connection TFT 52 is changed to a high voltage to result in an OFF state, illustration is omitted in FIG. 4.

Since the gate of the driving TFT 54 is connected to the power source line 40, the driving TFT 54 constitutes a diode connection, and a source end voltage of the driving TFT 54 gradually moves close to the voltage (Vwrt−Vth) and is applied to one end of the signal capacity Cs. On one hand, a signal voltage Vdata of the signal line 30 is applied to the other end of the signal capacitor Cs. The signal voltage Vdata takes a value from 0 V to 4 V, for example. Thereby, the voltage (Vdata−Vwrt+Vth) is written in the signal capacitor Cs, so that the signal writing action is terminated.

Figure 5:
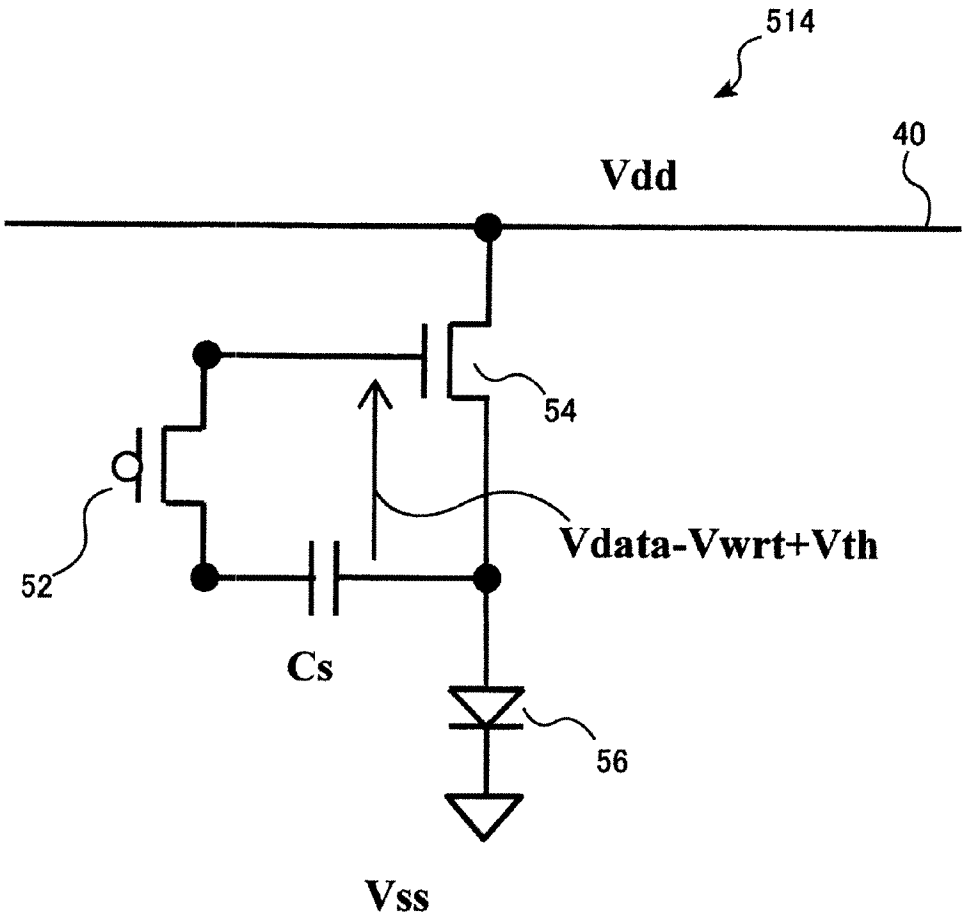
FIG. 5 is a schematic diagram showing a lightening action of the pixel circuit of the display device according to the first embodiment of the present invention.

FIG. 5 is a diagram showing a lightening action of the pixel circuit of the display device according to the first embodiment of the present invention.

At a lightening action time, the power source line scanning circuit 400 selectively scans the power source line 40 such that the voltage of the power source line 40 is changed from the writing voltage Vwrt to the voltage Vdd. Simultaneously therewith, the vertical scanning circuit 200 selectively scans the scanning line 20 so as to change the voltage of the scanning line 20 from the high voltage Vhigh to the low voltage Vlow. The voltage (Vdd) of the power source line 40 and the voltage (Vlow) of the scanning line 20 are fixed for about one frame period.

Since the voltage (Vdata−Vwrt+Vth) written in the signal capacitor Cs is applied between the source and the drain of the driving TFT 54, the driving TFT 54 can current-drive the organic EL element 56 without being affected by variations of the voltage Vth of the driving TFT 54. It should be note that the signal capacity Cs preferably has a capacitance value from 100 fF to 200 fF or more in order to secure a sufficient S/N ratio to take-off of a switch or the like.

Figure 6:
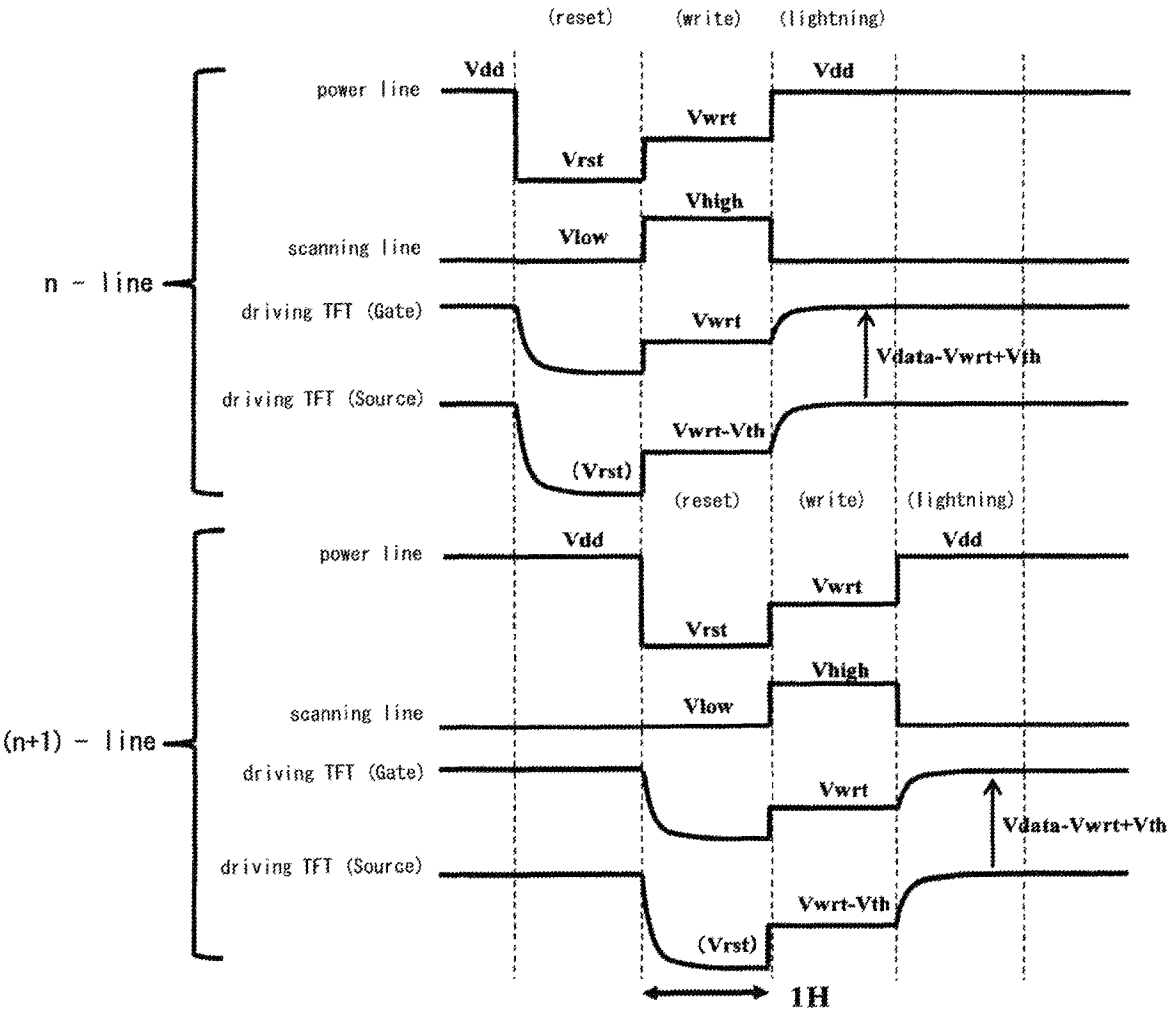
FIG. 6 is a diagram showing a timing chart of the pixel circuit of the display device according to the first embodiment of the present invention.

FIG. 6 is a timing chart of an action of the pixel circuit 500 explained with reference to FIG. 3 to FIG. 5. Regarding the voltage of the power source line 40, the voltage of the scanning line 20, the gate end voltage of the driving TFT 54, and the source end voltage of the driving TFT 54, FIG. 6 shows changes of voltages along time series of the action of the pixel circuit 500, where an action of a pixel circuit on n-th row is shown in an upper side while an action of a pixel circuit on (n+1)-th row is shown in a lower side.

First, at a reset time, the voltage of the power source line 40 changes from the voltage Vdd at the lightning time to the reset voltage Vrst, so that the gate end voltage and the source end voltage of the driving TFT 54 are reset from the voltage Vrst to the voltage (Vrst+Vth). Next, at a writing time, the voltage of the power source line 40 is changed to the writing voltage Vwrt and the voltage of the scanning line 20 is changed to the high voltage Vhigh, so that the source end voltage of the driving TFT 54 gradually moves close to the voltage (Vwrt−Vth). At this time, since the gate end of the driving TFT 54 is connected to the power source line 40, the gate end voltage of the driving TFT 54 changes to the voltage Vwrt. At the lightening time, the voltage of the power source line 40 is changed to the voltage Vdd and the voltage of the scanning line 20 is changed to the low voltage Vlow, so that the gate end voltage and the source end voltage of the driving TFT 54 are changed to the voltage (Vdata−Vwrt+Vth).

The (n+1)-th pixel circuit performs an action similar to that of the n-th pixel circuit with a delay of one horizontal scanning period (1 H) from the n-th pixel circuit. It should be noted that the reset period is set to one horizontal scanning period in FIG. 6, but the reset period may be performed over a plurality of horizontal scanning periods. Since it is necessary to shift the anode voltage of the organic EL element 56 having a large parasitic capacitance by several voltages at the reset time, when the reset period is performed over a plurality of horizontal scanning periods, it becomes possible to secure a margin on an action design largely.

As explained with reference to FIG. 1 to FIG. 6, in the first embodiment of the present invention, it becomes possible to write the signal voltage Vdata written in the signal line 30 in the signal capacitor Cs regulating a voltage between the source and the gate of the driving TFT 54 as it is without multiplying the signal voltage Vdata by a coefficient of 1 or less. Thereby, it becomes possible to reduce the signal voltage and it becomes possible to reduce power consumption accompanied by writing of the signal voltage to the signal line.

Further, according to the first embodiment of the present invention, since it is unnecessary to arrange another signal line for supplying a complementary signal to the scanning line 20, the pixel circuit 500 and the peripheral circuit can be made simple, in particular, the configuration of the scanning circuit 200 can be simplified.

In addition, according to the first embodiment of the present invention, since the capacitance of only the signal capacitor Cs is enough for a capacitance constituting the pixel circuit 500, it becomes possible to realize size reduction of the pixel circuit required according to multi-pixelization/high definition of the display device.

<Comparison with Conventional Art>

Figure 12:
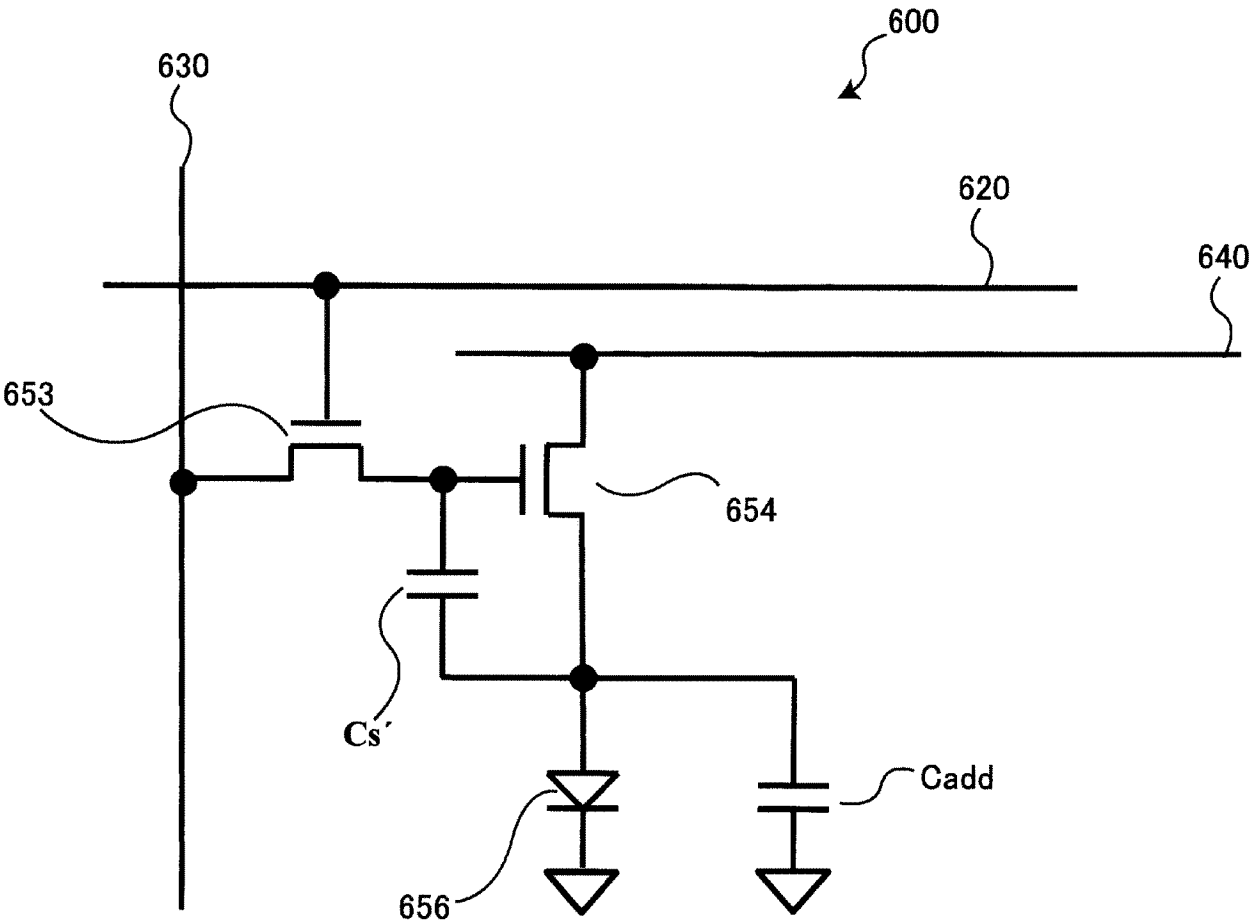
FIG. 12 is a schematic diagram showing a pixel circuit of a display device according to a conventional example.

FIG. 12 is a schematic diagram showing a pixel circuit 700 of a display device according to a conventional example. The conventional art shown in the above-described Patent Literature 1 is briefly described here and it is compared with the present invention.

In a conventional pixel circuit 600, since an additional capacitor Gadd is arranged, when a signal voltage of a signal line 630 is written in a signal capacitor Cs' provided within a pixel, a capacitance division between the signal capacitor Cs' and the additional capacitor Cadd occurs, so that the signal voltage is damped. Therefore, it is necessary to maintain the signal voltage of a signal line 620 in an approximately fixed value or higher, so that it is difficult to lower the signal voltage. Further, since a driving TFT 654 is turned ON (so-called mobility correction) at a writing time of the signal voltage, the source potential of the driving TFT 654 rises during writing so that the signal voltage written in the signal capacitor Cs' is further damped. From such a fact, it is difficult to lower the signal voltage to be written in the signal line 620 so that a power consumption due to writing of the signal voltage into the signal line is considerably increased. It should be noted that, though it is thought to lower the signal voltage by adjusting a capacitance ratio of the signal capacitor Cs' and the additional capacitor Cadd, it is necessary to take a large area of the capacitance in order to realize this, which is adverse to the demand for multi-pixelization/high definition.

On the other hand, in the first embodiment of the present invention, it has been made possible to solve the above-described problem in the conventional art because the signal voltage is reduced by writing the signal voltage Vdata written in the signal line 30 into the signal capacitor Cs regulating the voltage between the source and the gate of the driving TFT 54 as it is, space saving of a circuit is realized since only the signal capacitor Cs is enough for the capacitor constituting the pixel circuit 500, and the like.

Other embodiments of the present invention will be described below with reference to FIG. 7 to FIG. 10. It should be noted that, in the other embodiments, portions having same configurations as those of the portions in the first embodiment can obtain the same effects as those in the first embodiment.

<Second Embodiment>

Figure 7:
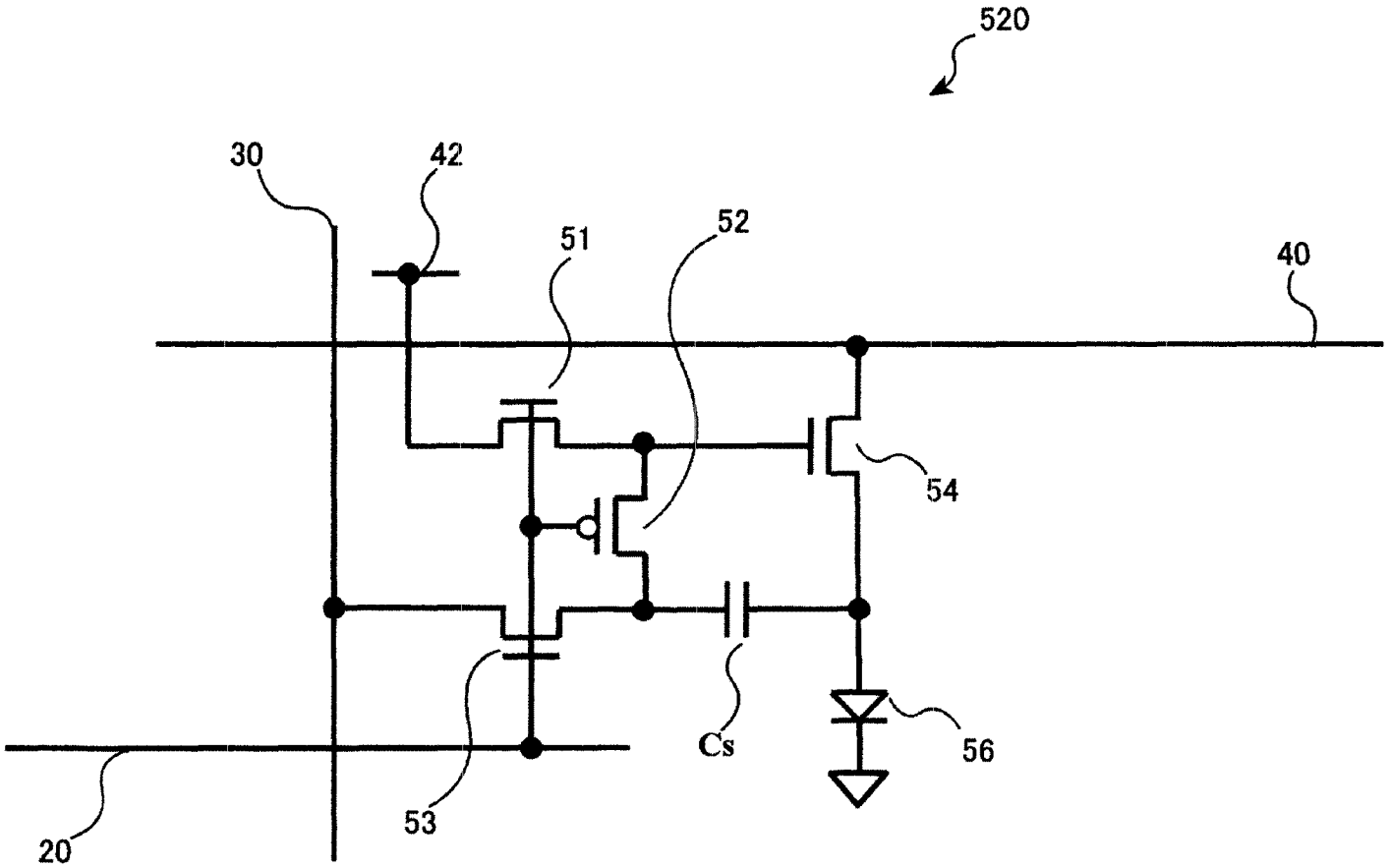
FIG. 7 is a schematic diagram of a pixel circuit of a display device according to a second embodiment of the present invention.

FIG. 7 is a schematic diagram of a pixel circuit 520 of a display device according to a second embodiment of the present invention. Unlike the first embodiment, the second embodiment is characterized in that a potential supply line 42 is arranged, the source side of the potential supply TFT 51 is not connected to the power source line 40 but is connected to the potential supply line 42. Here, a fixed potential (High value) is supplied to the potential supply line 42.

In the pixel circuit 520, since it is unnecessary to change the voltage of the power source line 40 at the writing time to the voltage Vwrt, which is different from the first embodiment, and it is possible to change the same to the voltage Vdd, the voltage of the power source line 40 can be changed to two values of the voltage Vdd and the voltage Vrst. Thereby, the power source line scanning circuit 400 can be further simplified and a slim border of the display device can be realized.

<Third Embodiment>

Figure 8:
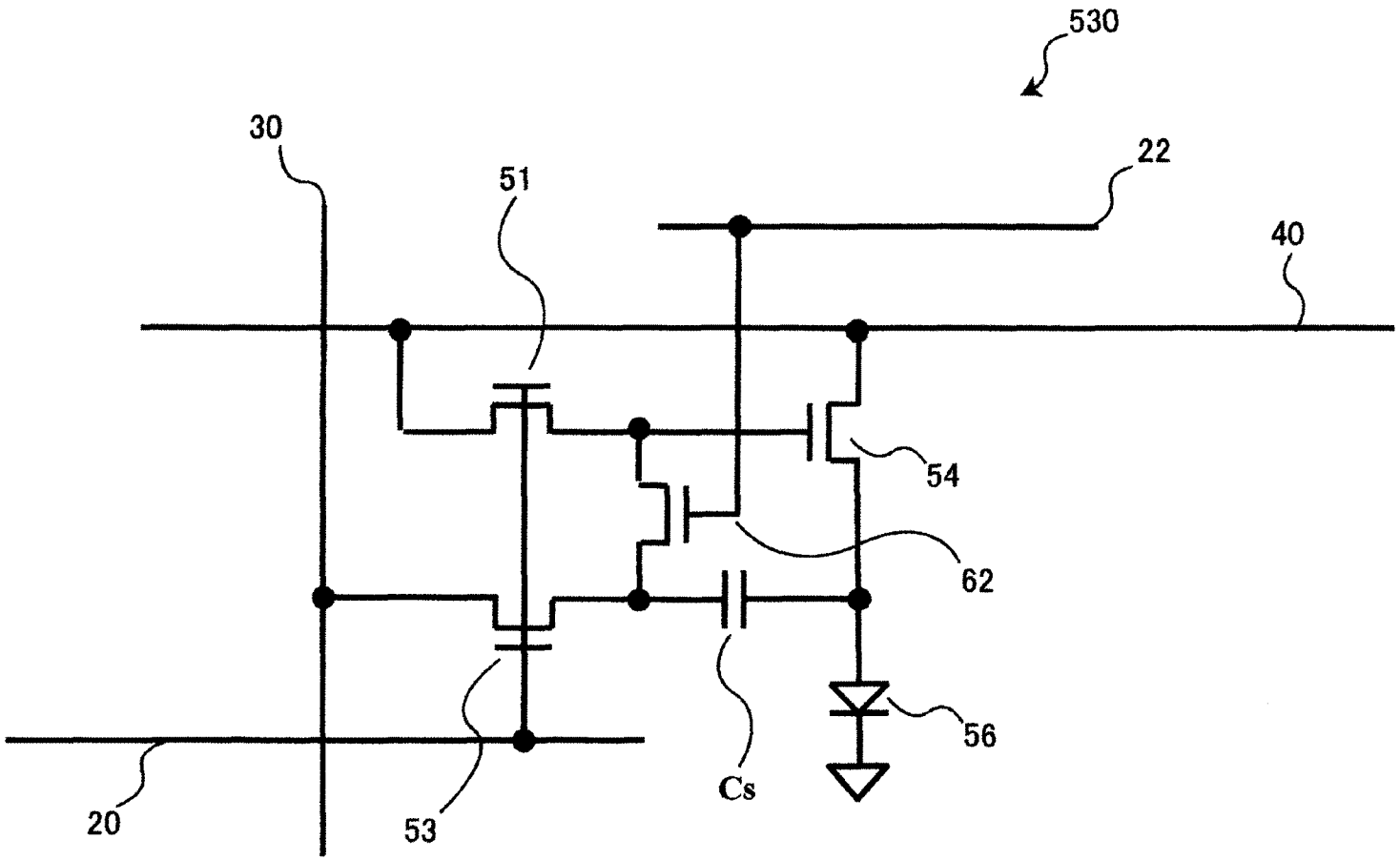
FIG. 8 is a schematic diagram of a pixel circuit of a display device according to a third embodiment of the present invention.

FIG. 8 is a schematic diagram of a pixel circuit 530 of a display device according to a third embodiment of the present invention. In the third embodiment, a second scanning line 22 is arranged unlike the first embodiment. The second scanning line 22 is connected to the vertical scanning circuit 200 and the vertical scanning circuit 200 controls the scanning line 20 and the second scanning line 22. Further, the gate of the Cs connection TFT 62 is not connected to the scanning line 20 but is connected to the second scanning line 22. In addition, an n-MOS type transistor is used in the Cs connection TFT 62.

In the third embodiment, since all of TFTs constituting the pixel circuit 530 can be constituted of n-MOS type transistors, a process cost can be reduced because it is unnecessary to produce a p-MOS type transistor. Further, as a material of the TFT, oxide semiconductor obtained by oxidizing indium/gallium/zinc, such as InGaZnO can be used, which can result in cost reduction.

Further, in the third embodiment, the second scanning line 22 for driving the gate of the Cs connection TFT 62 can be complementarily driven at a voltage reverse to that of the scanning line 20 for driving the gates of the signal writing TFT 53 and the potential supply TFT 51 and at a the same timing as that of the scanning line 20. Thereby, the configuration of the vertical scanning circuit 200 for driving the scanning line 20 and the second scanning line 22 can be simplified, and a slim border of the display device can be realized.

<Fourth Embodiment>

Figure 9:
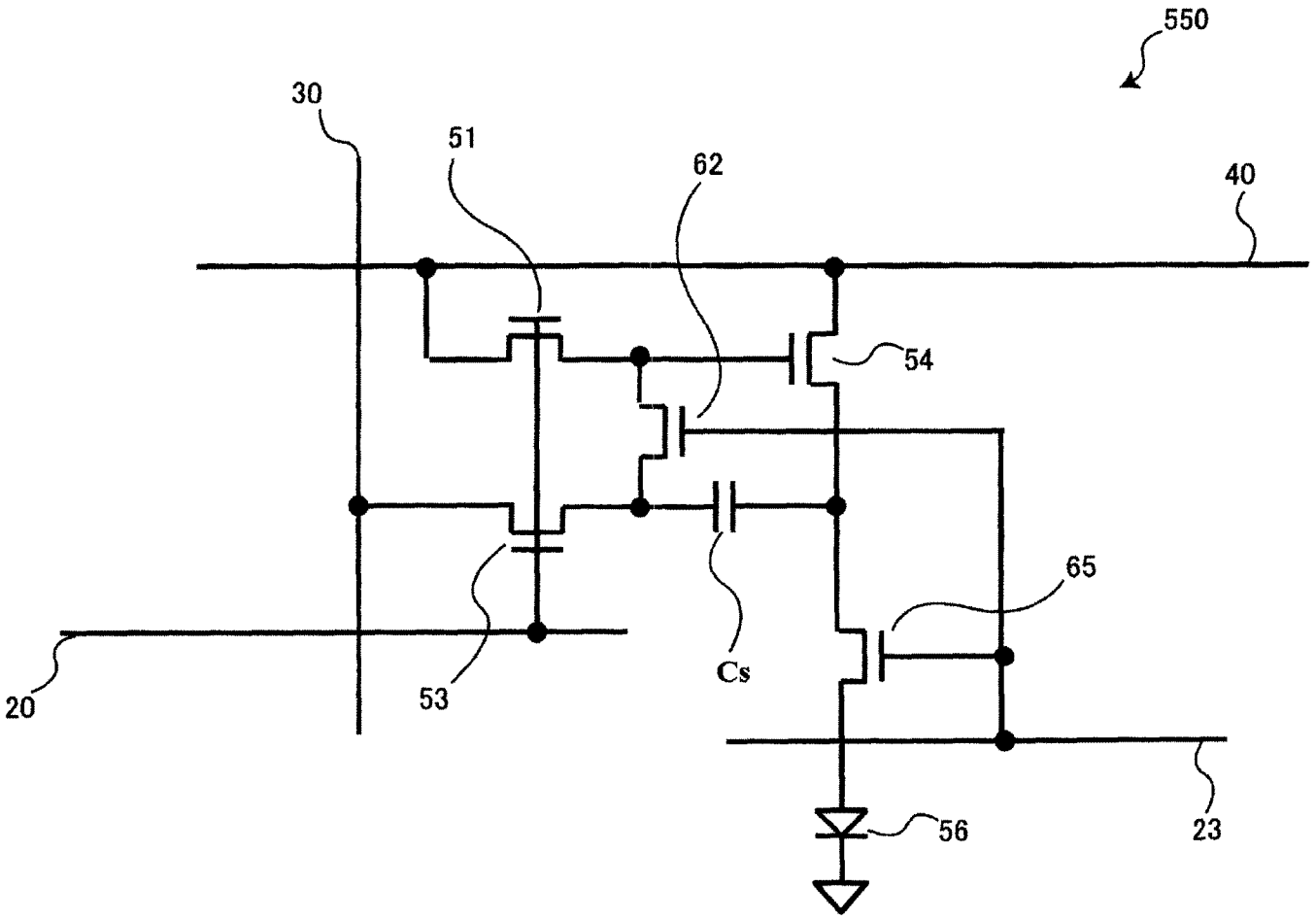
FIG. 9 is a schematic diagram of a pixel circuit of a display device according to a fourth embodiment of the present invention.

FIG. 9 is a schematic diagram of a pixel circuit 540 of a display device according to a fourth embodiment of the present invention. In the fourth embodiment, a third scanning line 23 is arranged. An n-MOS type transistor is used in the Cs connection TFT 62, and the gate thereof is not connected to the scanning line 20 but is connected to the third scanning line 23. Further, a lightening control TFT 65 is arranged between the source of the driving TFT 54 and one end of the signal capacitor CS, and the organic EL element 56. An n-MOS type transistor is used in the lightening control TFT 56, and the source thereof is connected to the organic EL element 56 and the drain thereof is connected to the driving TFT 54 and one end of the signal capacitor Cs, and the gate thereof is connected to the third scanning line 23. The fourth embodiment is thus characterized in that the gate of the Cs connection TFT 62 is separated from the respective gates of the potential supply TFT 51 and the signal writing TFT 53 and the gate together with the gate of the lightening control TFT 65 is connected to the third scanning line 23 to perform driving, as compared with the first embodiment.

The fourth embodiment can realize the process cost reduction owing to constituting the TFT constituting the pixel circuit 540 using the n-MOS type transistor and the cost reduction owing to using the oxide semiconductor as the material of the TFT.

Further, in the fourth embodiment, particularly by connecting the gate of the lightening control TFT 65 together with the gate of the Cs connection TFT to the third scanning line 23, a light-emitting duty of the organic EL element 56 within a frame period can be controlled arbitrarily without further providing another scanning line. Such a control of the light-emitting duty can be utilized for suppression of a "blur" phenomenon to a moving picture or as a luminance control function of a whole panel portion of the display device.

<Fifth Embodiment>

Figure 10:
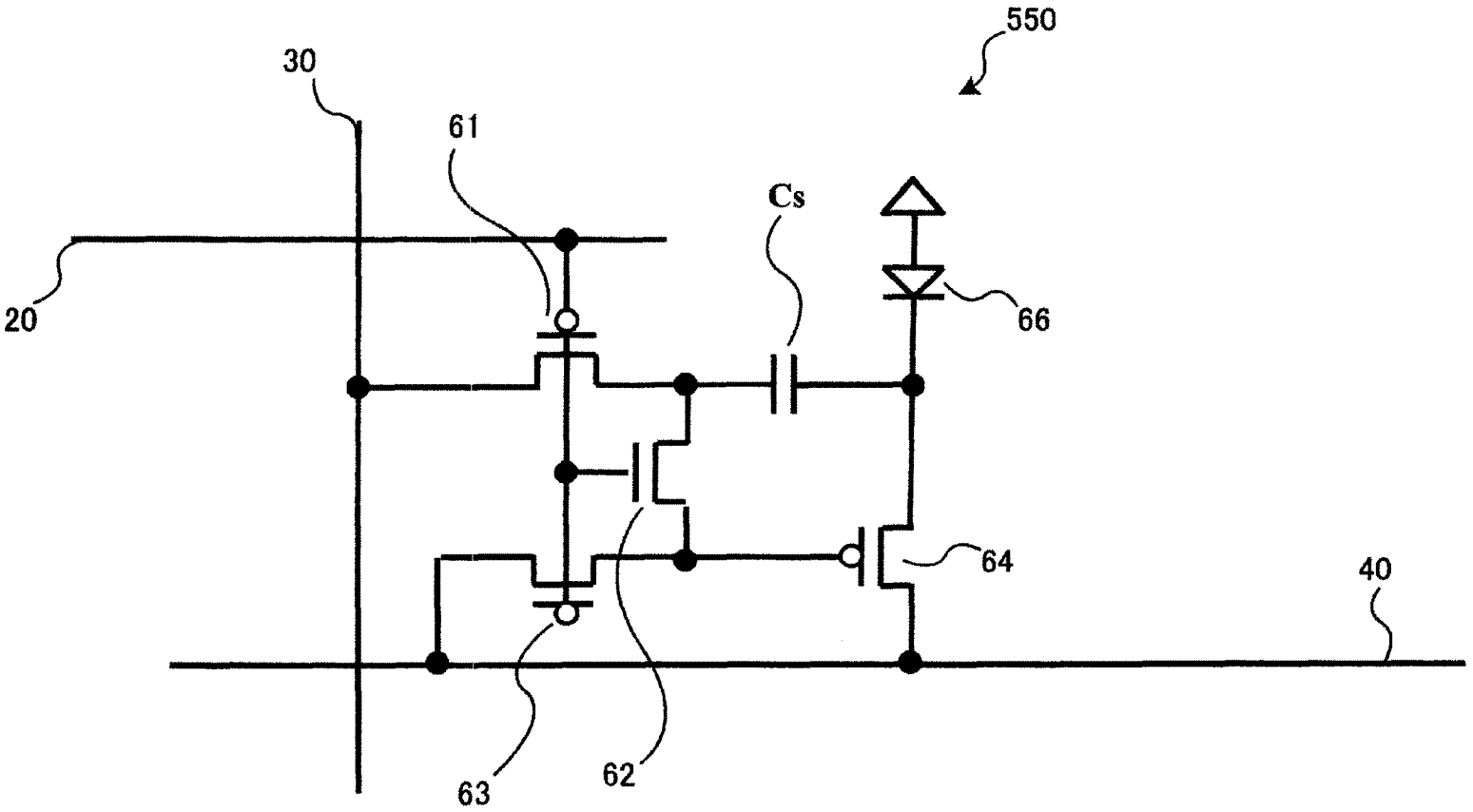
FIG. 10 is a schematic diagram of a pixel circuit of a display device according to a fifth embodiment of the present invention.

FIG. 10 is a schematic diagram of a pixel circuit 550 of a display device according to a fifth embodiment of the present invention. The fifth embodiment is different from the first embodiment in such a point that positive/negative of a voltage relationship is reversed, and n-MOS type/p-MOS type of the signal writing TFT 61, a Cs connection TFT 62, a potential supply TFT 63, and a driving TFT 64 are reversed. In addition, an element with a configuration having a common anode connection is used as an organic EL element 66.

Since an advantageous method for configuring an organic EL element is determined according to a material, a device structure, or the like of the organic EL element from a viewpoint of a light-emitting efficiency or a reliability life among methods for configuring a common cathode/common anode, an organic EL element adopting a common anode connection can be adopted depending on the material or the device structure of the organic EL element. According to the pixel circuit 550 in the fifth embodiment, it is possible to obtain the effect of the present invention explained regarding the first embodiment while raising the light-emitting efficiency using such an organic EL element to extend the reliability life.

<Sixth Embodiment>

Figure 11:
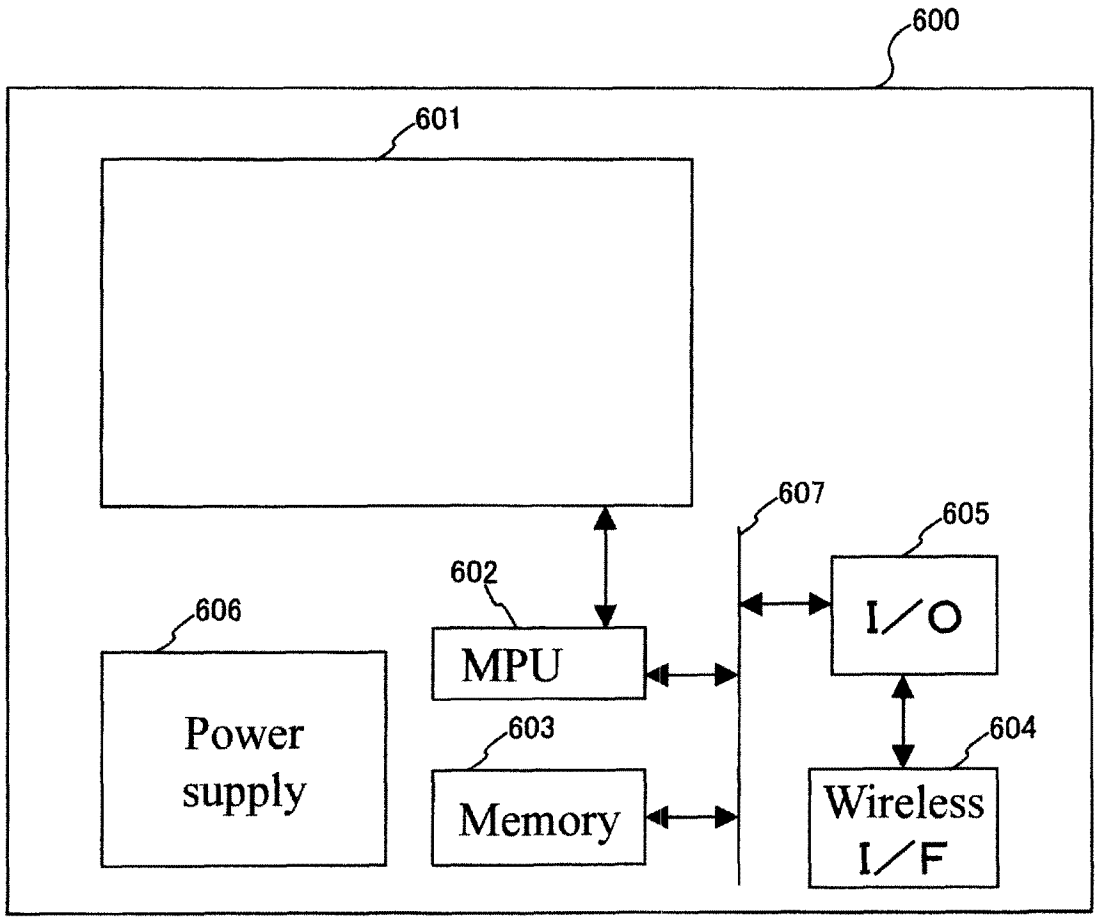
FIG. 11 is a configuration diagram of a tablet terminal according to a sixth embodiment of the present invention.

FIG. 11 is a configuration diagram of a tablet terminal 600 according to a sixth embodiment of the present invention. An organic EL display 601 has the configuration of the display device explained regarding the first embodiment, for example. The table terminal 600 has the organic display 601 and an MPU 602 for performing control on the whole tablet terminal, a memory 603, a wireless interface 604 including an antenna, a signal processing circuit 605 for performing signal processing of the wireless interface 604, and the like, which are mutually connected by an internal interface 607 or the like appropriately. Further, the tablet terminal 600 is also provided with a secondary battery 606. The respective constituent elements of the tablet terminal 600 explained above are configured by a conventional technique or the like known regarding the table terminal.

Though the organic EL display devices have been exemplified above as disclosure examples in the first embodiment to the sixth embodiment, any flat-panel type display devices such as a liquid crystal display device, another self-emitting type display device, or an electronic paper type display device having electrophoresis elements, and the like are involved as other application examples. Further, though these embodiments particularly have significant effect in a small-sized display device, of course, the present invention can be applied to middle-sized to large-sized display devices without being limited particularly.

Within a scope of the ideal of the present invention, it should be understood that since persons skilled in the art can anticipate various changed examples and modified examples, these changed examples and modified examples belong to the scope of the present invention. For example, one obtained by addition, deletion or design modification of a constituent element properly performed by persons skilled in the art, or one obtained by addition, omission, and condition change of a step can be involved in the scope of the present invention, as long as it is provided with the gist of the present invention.

What is claimed is:

1. A display device comprising:

power-source lines extending in a first direction and arranged in a second direction different from the first direction;

gate lines extending in the first direction and arranged in the second direction;

signal lines extending in the second direction and arranged in the first direction;

a cathode; and pixels arranged in a matrix form in the first direction and the second direction, each of the pixels including:

an organic light-emitting element including an anode terminal and a cathode terminal;

a driving transistor including a first source/drain terminal, a second source/drain terminal, and a gate terminal;

a capacitor including a first capacitor electrode and a second capacitor electrode;

a first switch;

a second switch; and a third switch, wherein, in each of the pixels:

the cathode terminal is connected to the cathode;

the anode terminal is connected to the second source/drain terminal and the first capacitor electrode;

the first source/drain terminal is connected to the corresponding power-source line and the first switch;

the gate terminal is connected to the first switch and the second switch;

the first switch is connected to the second switch, the third switch, and the corresponding gate line;

the second switch is connected to the second capacitor electrode and the third switch; and the third switch is connected to the corresponding signal line, and wherein at least one of the pixels is configured so that:

in a first timing, a reset voltage is applied to the corresponding power-source line, the first switch and the third switch are turned off, and the second switch is turned on;

in a second timing after the first timing, a writing voltage is applied to the corresponding power-source line, the first switch and the third switch are turned on, the second switch is turned off, the writing voltage is applied to the first source/drain terminal and the gate terminal, and a gray-scale voltage is applied to the corresponding signal line and the second capacitor terminal; and in a third timing after the second timing, a power-supply voltage is applied to the corresponding power-source line and the first source/drain terminal, the first switch and the third switch are turned off, the second switch is turned on, and the organic light-emitting element emits light based on a stored voltage of the capacitor.

2. The display device according to claim 1, wherein the at least one of the pixels is further configured so that:

a first voltage based on the reset voltage is applied to the anode terminal in the first timing;

a second voltage obtained by subtracting a threshold voltage of the driving transistor from the writing voltage is applied to the anode terminal and the first capacitor electrode in the second timing; and the stored voltage obtained by subtracting the second voltage from the gray-scale voltage is applied to the driving transistor in the third timing.

3. The display device according to claim 1, wherein the pixel adjacent to the at least one of the pixels in the second direction is configured so that:

in the second timing, the reset voltage is applied to the power-source line corresponding to the pixel adjacent to the at least one of the pixels, the first switch and the third switch are turned off, and the second switch is turned on;

in the third timing, the writing voltage is applied to the power-source line corresponding to the pixel adjacent to the at least one of the pixels, the first switch and the third switch are turned on, the second switch is turned off, the writing voltage is applied to the first source/drain terminal and the gate terminal, the gray-scale voltage is applied to the corresponding signal line and the second capacitor terminal; and in a fourth timing after the third timing, the power-supply voltage is applied to the power-source line corresponding to the pixel adjacent to the at least one of the pixels and the first source/drain terminal, the first switch and the third switch are turned off, the second switch is turned on, and the organic light-emitting element emits light based on the stored voltage of the capacitor.

4. A display device comprising:

a cathode; and pixels arranged in a matrix form in a first direction and a second direction different from the first direction, each of the pixels including:

an organic light-emitting element including an anode terminal and a cathode terminal;

a driving transistor including a first source/drain terminal, a second source/drain terminal, and a gate terminal;

a capacitor including a first capacitor electrode and a second capacitor electrode;

a first switch;

a second switch; and a third switch, wherein, in each of the pixels:

the cathode terminal is connected to the cathode electrode;

the second source/drain terminal is connected to the first capacitor electrode;

the first source/drain terminal is connected to the first switch;

the gate terminal is connected to the first switch and the second switch;

the first switch is connected to the second switch and the third switch; and the second switch is connected to the second capacitor electrode and the third switch, and wherein at least one of the pixels is configured so that:

in a first timing, a reset voltage is applied to the first source/drain terminal, the first switch and the third switch are turned off, and the second switch is turned on;

in a second timing after the first timing, the first switch and the third switch are turned on, the second switch is turned off, a writing voltage is applied to the first source/drain terminal and the gate terminal, and a gray-scale voltage is applied to the second capacitor terminal; and in a third timing after the second timing, a power-supply voltage is applied to the first source/drain terminal, the first switch and the third switch are turned off, the second switch is turned on, and the organic light-emitting element emits light based on a stored voltage of the capacitor.

5. The display device according to claim 4, wherein each of the driving transistors, the first switches, and the third switches is a N-channel transistor, and each of the second switches is a P-channel transistor.

6. The display device according to claim 4, wherein each of the driving transistors, the first switches, the second switches, and the third switches is a N-channel transistor.

7. The display device according to claim 4, wherein the second source/drain terminal is connected to the anode terminal in the at least one of the pixels.

8. The display device according to claim 4, wherein each of the pixels further comprises a fourth switch arranged between the second source/drain electrode and the anode terminal and between the first capacitor electrode and the anode terminal, and the at least one of the pixels is further configured so that:

the fourth switch is turned on in the first timing;

the fourth switch is turned off in the second timing; and the fourth switch is turned on in the third timing.

* * * * *